US005578898A

United States Patent [19]

Higashinakagawa et al.

[11] Patent Number: 5,578,898

[45] Date of Patent: Nov. 26, 1996

[54] SHADOW MASK AND CATHODE RAY TUBE

[75] Inventors: Emiko Higashinakagawa, Kawasaki; Mituharu Hagiwara, Tokyo; Shinzo Sugai, Yokohama; Yasuhisa Ohtake, Fukaya; Fumio Mori, Yokohama, all of Japan

[73] Assignee: Kabushiki Kaisha Toshiba, Kawasaki, Japan

[21] Appl. No.: 585,747

[22] Filed: Jan. 16, 1996

Related U.S. Application Data

[63] Continuation of Ser. No. 196,366, Feb. 15, 1994, abandoned.

[30] Foreign Application Priority Data

Feb. 15, 1993 [JP] Japan ..... 5-025486

[51] Int. Cl.[6] ..... H01J 29/80

[52] U.S. Cl. ..... 313/402

[58] Field of Search ..... 313/402, 403, 313/404, 405, 406, 407, 408

[56] References Cited

U.S. PATENT DOCUMENTS

| | | | |
|---|---|---|---|
| 4,046,601 | 9/1977 | Hook | 148/221 |
| 4,217,141 | 8/1980 | Schrittweiser | 75/244 |
| 4,292,565 | 9/1981 | Kanto | 313/407 |
| 4,537,793 | 8/1985 | Kehrer et al. | 427/551 |
| 4,665,338 | 5/1987 | Inaba et al. | 313/402 |
| 4,698,545 | 10/1987 | Inaba et al. | 313/402 |
| 4,777,340 | 10/1988 | Kobayashi et al. | 219/69.12 |
| 4,806,175 | 2/1989 | Wendt | 148/217 |
| 4,810,927 | 3/1989 | Watanabe | 313/402 |
| 4,853,049 | 8/1989 | Loyd | 148/318 |
| 4,872,924 | 10/1989 | Kumada et al. | 148/634 |
| 5,028,836 | 7/1991 | Hirasawa | 313/402 |

FOREIGN PATENT DOCUMENTS

| | | | |
|---|---|---|---|
| 59-165339 | 9/1984 | Japan | H01J 29/07 |
| 59-211942 | 11/1984 | Japan | H01J 29/07 |
| 1-194243 | 8/1989 | Japan | H01J 29/07 |

OTHER PUBLICATIONS

Chemical Rubber Co. "Hand Book of Chemistry and Physics" 43rd Edition 1961 pp. 1530–1531, 1534–1535.

Japanese Patent Disclosure (KOKAI) No. 3–266338 (English Abstract), Nov. 1991.

*Primary Examiner*—Nimeshkumar D. Patel

*Attorney, Agent, or Firm*—Oblon, Spivak, McClelland, Maier & Neustadt P.C.

[57] ABSTRACT

A shadow mask with a low thermal expandability of an Fe—Ni-based alloy and a high surface hardness is disclosed. This shadow mask includes a mask main body consisting of an Fe—Ni-based alloy containing iron and nickel as main constituents, a large number of fine electron beam apertures formed in the mask main body, and a surface layer formed on the surface of the mask main body and containing at least one compound selected from the group consisting of iron nitride, iron nickel nitride, iron boride, iron nickel boride, iron silicide, and iron nickel silicide.

24 Claims, 1 Drawing Sheet

SHADOW MASK AND CATHODE RAY TUBE

This is a Continuation of application Ser. No. 08/196,366, filed on Feb. 15, 1994, now abandoned.

BACKGROUND OF THE INVENTION

1. Field of the Invention

The present invention relates to a shadow mask and a cathode ray tube, especially a color cathode ray tube, i.e., a color-CRT.

2. Description of the Related Art

Generally, a color-CRT reproduces a color image by selectively passing electron beams emitted from an electron gun through a shadow mask in which a large number of electron beam apertures are formed, and causing the electron beams to bombard predetermined positions of a phosphor layer formed on the inner surface of a glass envelope. In this case, about ⅓ or less of all of the emitted electron beams passes through the electron beam apertures, and the rest of the electron beams directly bombards the shadow mask to heat it. If the shadow mask is thus heated to cause thermal expansion, the positions of the electron beam apertures are displaced from the design criterion, leading to a color misregistration on the phosphor screen.

For this reason, in place of a conventional steel material consisting of low-carbon rimmed cold-rolled steel or low-carbon aluminum-killed cold-rolled steel, an Fe—Ni-based alloy having a small thermal expansion coefficient, such as a 36-wt % Ni—Fe alloy (invar alloy), has become widely used as a shadow mask material recently.

This Fe—Ni-based alloy has the advantage of an extremely small thermal expansion coefficient but also has the disadvantage of a low hardness. As an example, in a process of manufacturing a shadow mask plate material from the invar alloy, if the shadow mask plate material is softened through annealing, the vickers hardness of the resultant plate material becomes approximately 120 to 140. Consequently, a shadow mask made from this plate material resonates with external vibrations, e.g., vibrations from loudspeakers. In the case where shadow mask resonates, a positional difference is produced between a large number of electron beam apertures formed in the shadow mask and a phosphor layer, resulting in a color misregistration. Especially in recent color-CRTs, the diameter and the pitch of the electron beam apertures tend to be decreased in order to realize a high definition and a high image quality. If the positional difference is caused between the electron beam apertures and the phosphor layer, therefore, the degree of the color misregistration further increases.

On the other hand, requirements for the characteristics of color-CRTs, particularly color-CRTs for industrial purposes, such as displays, have become stricter every year, and so a demand has arisen for images with a higher definition and a higher quality. In view of these strict requirements for the characteristics of color-CRTs, therefore, preventing a color misregistration by suppressing howling of the shadow mask becomes important in achieving a higher definition and a higher quality of images.

SUMMARY OF THE INVENTION

It is an object of the present invention to provide a shadow mask which has a low thermal expandability of an Fe—Ni-based alloy, and in which a high surface hardness discourages howling.

It is another object of the present invention to provide a cathode ray tube which can obtain images with extremely high definition and quality.

According to the present invention, there is provided a shadow mask comprising:

a mask main body consisting of an Fe—Ni-based alloy containing iron and nickel as main constituents;

a large number of fine electron beam apertures formed in the mask main body; and a surface layer formed on the surface of the mask main body and containing at least one compound selected from the group consisting of iron nitride, iron nickel nitride, iron boride, iron nickel boride, iron silicide, and iron nickel silicide.

According to the present invention, there is provided a shadow mask comprising:

a mask main body consisting of an Fe—Ni-based alloy containing iron and nickel as main constituents;

a large number of fine electron beam apertures formed in the mask main body; and a surface layer formed on the surface of the mask main body and containing (a) $Fe_xO_4$, wherein $2.2 \leqq x \leqq 3.8$, and (b) at least one compound selected from the group consisting of iron nitride, iron nickel nitride, iron boride, iron nickel boride, iron silicide, and iron nickel silicide.

According to the present invention, there is provided a cathode ray tube comprising:

an electron gun assembly for emitting electron beams;

a fluorescent screen for emitting light upon receipt of the electron beams; and a shadow mask provided between the electron gun assembly and the fluorescent screen, and comprising:

a mask main body consisting of an Fe—Ni-based alloy containing iron and nickel as main constituents;

a large number of fine electron beam apertures formed in the mask body; and a surface layer formed on the surface of the mask body and containing at least one compound selected from the group consisting of iron nitride, iron nickel nitride, iron boride, iron nickel boride, iron silicide, and iron nickel silicide.

According to the present invention, there is provided a cathode ray tube comprising:

an electron gun assembly for emitting electron beams;

a fluorescent screen for emitting light upon receipt of the electron beams; and a shadow mask provided between the electron gun assembly and the fluorescent screen, and comprising:

a mask main body consisting of an Fe—Ni-based alloy containing iron and nickel as main constituents;

a large number of fine electron beam apertures formed in the mask body; and a surface layer formed on the surface of the mask body and containing (a) $Fe_xO_4$, wherein $2.2 \leqq x \leqq 3.8$, and (b) at least one compound selected from group consisting of iron nitride, iron nickel nitride, iron boride, iron nickel boride, iron silicide, and iron nickel silicide.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawing, which is incorporated in and constitutes a part of the specification, illustrates presently preferred embodiments of the invention and, together with the general description given above and the detailed description of the preferred embodiments given below, serves to explain the principles of the invention.

DETAILED DESCRIPTION OF THE PREFERRED EMBODIMENTS

A color-CRT according to the present invention will be described with reference to FIG. 1.

Figure 1:
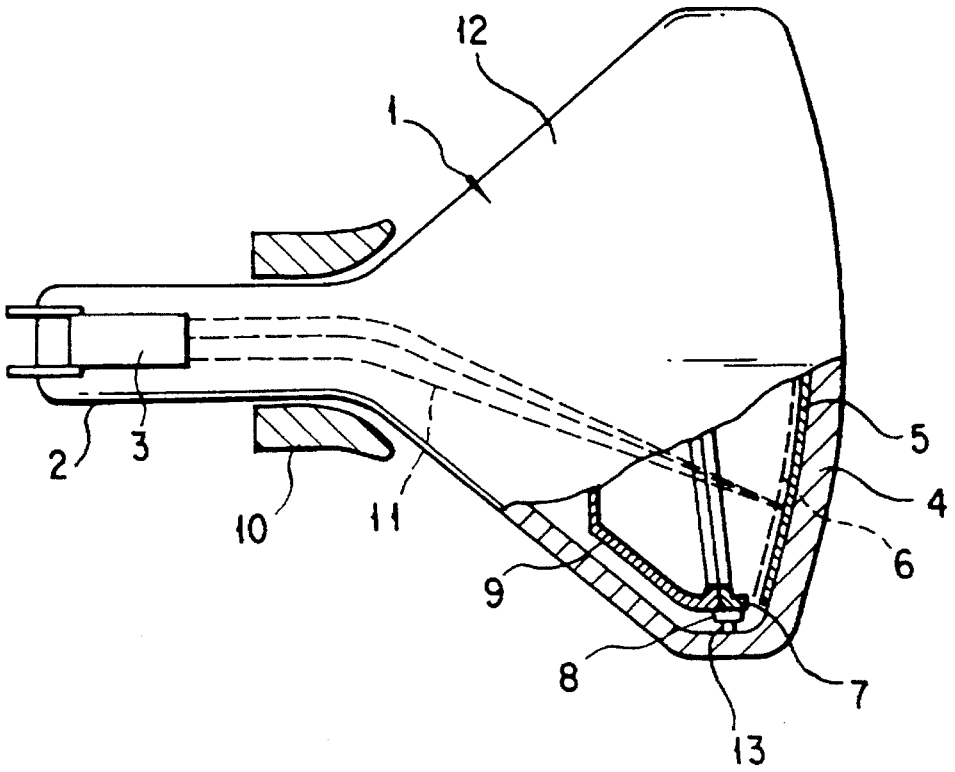
FIG. 1 is a sectional view showing a color-CRT according to the present invention.

A color-CRT, as shown in FIG. 1, comprises a glass envelope 1, in-line electron guns 3 emitting three electron beams 11, and a phosphor screen 5 containing red, green, and blue phosphors which emit visible light when excited by the electron beams 11. The envelope 1 is constituted a panel 4, a funnel portion 12, and connecting neck 2. Electron guns 3 are located in the neck 2 of the envelope 1, while the phosphors, arranged in vertical stripes of cyclically repeating colors, are coated on the inner surface of the panel 4 of the envelope 1. Electron beams 11 are deflected by magnetic fields produced by deflection yoke 10 surrounding a portion of the neck 2.

Near screen 5 is a shadow mask 6 having a plurality of apertures (not shown). Shadow mask 6 is attached to a mask frame 7 supported within the envelope by frame holders 8 which are releasably mounted on a large number of panel pins 13 embedded in side walls of panel 4. An inner shield 9, also attached to the mask frame 7, extends part of the way along funnel 12 toward electron guns 3, shielding the electron beams 11 from the effects of terrestrial magnetism. After emittion from electron guns 3, electron beams 11 are accelerated, deflected by deflection yoke 10, and converged. They then pass through the apertures of shadow mask 6 to bombard phosphor screen 5, reproducing a color image.

Figure 2:
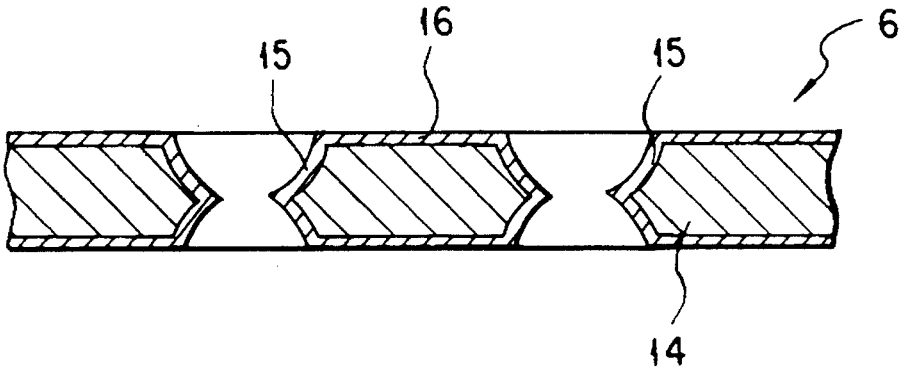
FIG. 2 is a sectional view showing the main part of the shadow mask according to the present invention.

As shown in FIG. 2, the shadow mask 6 includes a mask main body 14 consisting of an Fe—Ni-based alloy containing iron and nickel as main constituents, a large number of fine electron beam apertures 15 formed in the mask main body 14, and a surface layer 16 formed on the surface of the mask main body 14.

The Fe—Ni-based alloy preferably has a composition containing 30 to 45 wt % of nickel and the balance essentially consisting of iron. If the nickel amount falls outside the above range, the thermal expansion coefficient of the shadow mask can no longer be $7\times10^{-6}$/°C. or less. This increases a displacement of the electron beam apertures when the temperature rises due to bombardment of electrons.

In this Fe—Ni-based alloy, a portion of nickel may be substituted with at least one metal selected from cobalt and chromium. The mask main body consisting of this Fe—Ni-based alloy has a higher resistance and a smaller thermal expansion coefficient. The substitution amount of the at least one metal selected from cobalt and chromium preferably ranges between 0.01 and 10 wt %. If, however, nickel is to be substituted with both of cobalt and chromium, it is desirable that the cobalt amount be larger than the chromium amount.

The above Fe—Ni-based alloy may be added with 0.01 to 0.5 wt % of at least one element selected from the group consisting of V, Cr, Nb, Ta, W, Mo, Ti, Si, Co, and Al, as an element which easily forms any of a nitride, boride, and silicide. The addition of such an element makes it possible to readily form a surface layer containing a nitride such as iron nitride on the surface of the mask main body, therefore increasing the surface hardness of the shadow mask. If the addition amount of the element is less than 0.01 wt %, the effect for easily forming any of nitride, boride, and silicide does not appear. If the addition amount of the element exceeds 0.5 wt %, not only no better addition effect can be obtained, but also an increase in the thermal expansion coefficient results.

The Fe—Ni-based alloy may contain, as unavoidable impurity elements, 0.02% or less of C, 0.01% or less of S, 0.1% or less of P, and 0.5% or less and 0.1% or less of Mn and Si, respectively, both as deoxidizing agents, all in weight ratio.

The electron beam apertures 15 are formed in, e.g., a matrix manner in the mask main body 14.

As the surface layer 16, two types of surface layers having the compositions and the structures explained below are usable.

1) Surface layer

This surface layer contains at least one compound selected from the group consisting of iron nitride, iron nickel nitride, iron boride, iron nickel boride, iron silicide, and iron nickel silicide.

The above iron nitride, iron nickel nitride, iron boride, iron nickel boride, iron silicide, and iron nickel silicide are preferably represented by formulas $Fe_xN$, wherein $3.2\leqq x\leqq4.8$, $Fe_yNi_zN$, wherein $2.2\leqq y\leqq3.8$, $0.2\leqq z\leqq1.8$, $Fe_4B$, $Fe_3NiB$, $Fe_2Si$, and FeNiSi, respectively. A surface layer containing such as compound can increase the surface hardness of the shadow mask.

If the Fe—Ni-based alloy as the material of the mask main body contains an element which easily forms any of a nitride, boride, and silicide, i.e., at least one element selected from the group consisting of V, Cr, Nb, Ta, W, Mo, Ti, Si, Co, and Al, the above surface layer may contain at least one compound of the nitrides, borides, and silicides of these elements.

The surface layer has a thickness of 0.1 to 20 μm. If the thickness of the surface layer is less than 1.5 μm, a shadow mask in which howling is suppressed becomes difficult to obtain. If the thickness of the surface layer exceeds 20 μm, the surface layer may become brittle or may cause peeling. The thickness of the surface layer more preferably ranges from 0.5 to 5 μm.

The surface layer preferably has a vickers hardness of 170 or higher. This Vickers hardness indicates a value measured at an intermediate position of the surface layer.

Assuming the hardness of the surface layer is $H_1$ and the hardness of the mask main body is $H_0$, the hardness ratio ($H_1/H_0$) is preferably 1.05 or more. If the hardness ratio is less than 1.05, it becomes difficult to obtain a shadow mask with a high howling resistance. The hardness ratio ($H_1/H_0$) is more preferably 1.2 or more.

A shadow mask having the above surface layer, e.g., a surface layer containing iron nitride and/or iron nickel nitride, is manufactured by the following method.

First, the individual components of an Fe—Ni-based alloy adjusted to have a predetermined alloy composition are melted and cast, and the resultant cast material is hot-rolled to have an intermediate plate thickness. The hot-rolled material thus obtained is repeatedly subjected to cold rolling and annealing until a predetermined plate thickness is obtained. Subsequently, etching or the like is performed for the resultant desired cold-rolled material to form a large number of electron beam apertures in, e.g., a matrix manner. After annealing is performed as needed, the plate material in which the electron beam apertures are formed is warm-molded (press-molded) into a desired shadow mask shape, thereby making a mask main body. Subsequently, the mask main body is heat-treated in a nitrogen atmosphere or an ammonia decomposing gas atmosphere to form a surface layer containing iron nitride and/or iron nickel nitride, thereby manufacturing a shadow mask.

It is preferable that the above heat treatment be performed at a temperature of 530° to 600° C. for one to 30 minutes.

The nitriding treatment is preferably performed under conditions by which one or both of iron nitride represented by $Fe_4N$ and iron nickel nitride represented by $Fe_3NiN$ are formed. That is, if the nitriding proceeds excessively, $Fe_3N$ with a stoichiometrically large nitrogen amount is formed as iron nitride, and $Fe_2NiN$ with a stoichiometrically large nitrogen amount is formed as iron nickel nitride. A surface layer containing such nitride with a stoichiometrically large nitrogen amount readily peels from the mask main body composed of the Fe—Ni-based alloy.

In the formation of the surface layer containing the above nitride, the Fe—Ni-based alloy as the material of the mask main body preferably has a nitrogen content of 300 ppm or less. If the nitrogen content of the Fe—Ni-based alloy exceeds 300 ppm, nitriding may proceed to not only the surface but also the interior of the mask main body in the nitriding treatment, increasing the hardness of the whole mask main body. To facilitate the nitriding on the surface of the mask main body, however, the lower limit of the nitrogen content of the Fe—Ni-based alloy is preferably set at 30 ppm.

By performing the heat treatment for the mask main body consisting of the Fe—Ni-based alloy in the nitrogen atmosphere or the ammonia decomposing gas atmosphere as described above, nitrogen is introduced to only the surface of the mask main body, forming the surface layer containing one or both of iron nitride and iron nickel nitride. Consequently, a shadow mask in which the surface hardness is raised is manufactured. In addition, since the etching and the press molding are performed for the plate material consisting of the Fe—Ni-based alloy and having no surface layer with a high hardness, it is possible to manufacture a mask main body having high-accuracy electron beam apertures and a high shape accuracy.

Note that it is also possible to form the surface layer containing iron nitride and/or iron nickel nitride by performing ion implantation of nitrogen on the surface of the mask main body and annealing the resultant material. This ion implantation of nitrogen is preferably performed at an acceleration voltage of 100 to 5,000 kev and a dose of $10^2$ ions/cm$^2$ to $10^{25}$ ions/cm$^2$. The annealing temperature is preferably 400° to 800° C.

A surface layer containing iron boride and/or iron nickel boride is formed by performing ion implantation of boron on the surface of the mask main body and annealing the resultant material. This ion implantation of boron is preferably performed at an acceleration voltage of 100 to 5,000 keV and a dose of $10^2$ ions/cm$^2$ to $10^{25}$ ions/cm$^2$. The annealing temperature is preferably 400° to 800° C.

A surface layer containing iron silicide and/or iron nickel silicide is formed by performing ion implantation of silicon on the surface of the mask main body and annealing the resultant material. This ion implantation of silicon is preferably performed at an acceleration voltage of 500 to 8,000 kev and a dose of $10^2$ ions/cm$^2$ to $10^{25}$ ions/cm$^2$. The annealing temperature is preferably 400° to 800° C.

2) Surface layer

This surface layer contains (a) $Fe_xO_4$, wherein $2.2 \leqq x 3.8$, and (b) at least one compound selected from the group consisting of iron nitride, iron nickel nitride, iron boride, iron nickel boride, iron silicide, and iron nickel silicide.

The above iron nitride, iron nickel nitride, iron boride, iron nickel boride, iron silicide, and iron nickel silicide are preferably represented by formulas $Fe_xN$, wherein $3.2 \leqq x \leqq 4.8$, $Fe_yNi_zN$, wherein $2.2 \leqq y \leqq 3.8$, $0.2 \leqq z \leqq 1.8$, $Fe_4B$, $Fe_3NiB$, $Fe_2Si$, and FeNiSi, respectively.

The component (a) of the above surface layer is preferably contained in an amount required to blacken the surface layer.

If the Fe—Ni-based alloy as the material of the mask main body contains an element which easily forms any of a nitride, boride, and silicide, i.e., at least one element selected from the group consisting of V, Cr, Nb, Ta, W, Mo, Ti, Si, Co, and Al, the above surface layer may contain at least one compound of the nitrides, borides, and silicides of these elements.

The surface layer has a thickness of 0.1 to 20 μm. If the thickness of the surface layer is less than 0.1 μm, a shadow mask in which howling is suppressed becomes difficult to obtain. If the thickness of the surface layer exceeds 20 μm, the surface layer may become brittle or may cause peeling. The thickness of the surface layer more preferably ranges from 0.5 to 5 μm.

The surface layer preferably has a Vickers hardness of 170 or higher. This Vickers hardness indicates a value measured at an intermediate position of the surface layer. A surface layer with a vickers hardness of the above value is formed by, e.g., controlling the composition ratio of the component (a) to the component (b).

Assuming the hardness of the surface layer is $H_1$ and the hardness of the mask main body is $H_0$, the hardness ratio ($H_1/H_0$) is preferably 1.05 or more. If the hardness ratio is lower than 1.05, it becomes difficult to obtain a shadow mask with a high howling resistance. The hardness ratio ($H_1/H_0$) is more preferably 1.2 or more.

It is desirable that the thermal reflectance on the surface of the above surface layer is 0.60 or more. A surface layer having such thermal reflectance is formed by, e.g., controlling the composition ratio of the component (a) to the component (b).

A shadow mask having the above surface layer containing the component (a) and the component (b), e.g., a surface layer containing iron nitride and/or iron nickel nitride, is manufactured by the following method.

First, the individual components of an Fe—Ni-based alloy adjusted to have a predetermined alloy composition are melted and cast, and the resultant cast material is hot-rolled to have an intermediate plate thickness. The hot-rolled material thus obtained is repeatedly subjected to cold rolling and annealing until a predetermined plate thickness is obtained. Subsequently, etching or the like is performed for the resultant desired cold-rolled material to form a large number of electron beam apertures in, e.g., a matrix manner. After annealing is performed as needed, the plate material in which the electron beam apertures are formed is warm-molded (press-molded) into a desired shadow mask shape, thereby making a mask main body. Subsequently, the mask main body is heat-treated in a nitrogen atmosphere or an ammonia decomposing gas atmosphere. The mask main body is then heat-treated in a steam or carbon dioxide gas atmosphere for oxidation to form a surface layer containing (a) $Fe_xO_4$, wherein $2.2 \leqq x \leqq 3.8$, and (b) iron nitride and/or iron nickel nitride, thereby manufacturing a shadow mask. The formation conditions of this surface layer are properly set in accordance with the composition of the Fe—Ni-based alloy and the thickness of the mask main body.

The above nitriding treatment is not particularly limited as long as at least one nitride selected from nitrides of iron and nickel is formed on the surface. However, it is preferable that the heat-treatment temperature be 530° to 600° C., and the heat-treatment time be one to 30 minutes.

The oxidation is performed in, e.g., a steam or carbon dioxide gas atmosphere. The heat-treatment temperature is preferably 530° to 600° C., and the heat-treatment time is preferably one to 30 minutes. If $Fe_xO_4$, wherein $2.2 \leqq x \leqq 3.8$, is produced in the surface layer, the oxidation also can be performed before the nitriding treatment.

By performing the nitriding treatment as described above, nitrogen is introduced to only the surface of the mask main body consisting of the Fe—Ni-based alloy. In addition, the above oxidation forms a black surface layer containing the component (a) and the component (b). Consequently, a shadow mask in which the surface hardness is raised and the surface heat radiation performance is improved is manufactured. Furthermore, since the etching and the press molding are performed for the plate material consisting of the Fe—Ni-based alloy and having no surface layer with a high hardness, it is possible to manufacture a mask main body having high-accuracy electron beam apertures and a high shape accuracy.

Note that it is also possible to form the surface layer containing the component (a) and the component (b) which is iron nitride and/or iron nickel nitride by performing a heat treatment in an ammonia gas atmosphere containing oxygen.

In addition, the surface layer containing the component (a) and the component (b) which is iron nitride and/or iron nickel nitride can also be formed by performing ion implantation of nitrogen on the surface of the mask main body and performing a heat treatment in a steam or carbon dioxide gas atmosphere, e.g., performing oxidation. This ion implantation of nitrogen is preferably performed at an acceleration voltage of 100 to 5,000 kev and a dose of $10^2$ ions/cm$^2$ to $10^{25}$ ions/cm$^2$.

A surface layer containing iron boride and/or iron nickel boride as the component (b) is formed by performing ion implantation of boron on the surface of the mask main body and the oxidation described above. This ion implantation of boron is preferably performed at an acceleration voltage of 100 to 5,000 keV and a dose of $10^2$ ions/cm$^2$ to $10^{25}$ ions/cm$^2$.

A surface layer containing iron silicide and/or iron nickel silicide as the component (b) is formed by performing ion implantation of silicon on the surface of the mask main body and the oxidation described above. This ion implantation of silicon is preferably performed at an acceleration voltage of 500 to 8,000 kev and a dose of $10^2$ ions/cm$^2$ to $10^{25}$ ions/cm$^2$.

The shadow mask according to the present invention has a structure in which the surface layer containing at least one compound selected from the group consisting of iron nitride, iron nickel nitride, iron boride, iron nickel boride, iron silicide, and iron nickel silicide is formed on the surface of the mask main body having a large number of electron beam apertures and consisting of an Fe—Ni-based alloy. The shadow mask of this type is improved in the howling resistance because the vickers hardness of the surface is raised to 170 or higher due to the formation of the surface layer.

In addition, since the shadow mask includes the mask main body composed of the Fe—Ni-based alloy, a low thermal expandability that the Fe—Ni-based alloy originally possesses is maintained in the shadow mask.

The shadow mask according to the present invention, therefore, is improved in the howling resistance and has the low thermal expandability of the Fe—Ni-based alloy. For this reason, a color-CRT incorporating the shadow mask of the present invention can provide high-definition, high-quality images, since a color misregistration is prevented in this color-CRT.

Another shadow mask according to the present invention has a structure in which a black surface layer containing (a) $Fe_xO_4$, wherein $2.2 \leqq x \leqq 3.8$, and (b) at least one compound selected from the group consisting of iron nitride, iron nickel nitride, iron boride, iron nickel boride, iron silicide, and iron nickel silicide is formed on the surface of the mask main body having a large number of electron beam apertures and consisting of an Fe—Ni-based alloy. The shadow mask of this type is improved in the howling resistance because the Vickers hardness of the surface is raised to 170 or higher due to the formation of the surface layer.

In addition, the black surface layer containing the component (a) and the component (b) has a thermal reflectance of 0.60 or higher. This makes it possible to effectively suppress the temperature rise upon bombardment of electron beams.

Furthermore, since the shadow mask includes the mask main body composed of the Fe—Ni-based alloy, a low thermal expandability that the Fe—Ni-based alloy originally possesses is maintained in the shadow mask.

The shadow mask according to the present invention, therefore, is improved in the howling resistance, effectively reduces the temperature rise upon bombardment of electron beams, and has the low thermal expandability of the Fe—Ni-based alloy. For this reason, a color misregistration is prevented in a color-CRT incorporating the shadow mask of the present invention, and so high-definition, high-quality images can be obtained by this color-CRT.

The present invention will be described in more detail below by way of its examples.

EXAMPLES 1–10

The components of Fe—Ni-based alloys having the compositions given in Table 1 below were melted and cast to make ten types of cast materials with dimensions of 200 mm×800 mm×200 mm. These cast materials were then hot-rolled between hot rolls at a temperature of 1,100° C. so as to have a plate thickness of 3 mm. Subsequently, each resultant hot-rolled material was repeatedly subjected to cold rolling using cold rolls and annealing twice, thereby making a 0.25 mm thick plate material.

A large number of electron beam apertures were formed in a matrix manner in each plate material by photoetching, and the resultant plate material was annealed in a dry hydrogen atmosphere at 900° C. for 20 minutes. Subsequently, these plate materials were so press-molded as to have a predetermined mask shape, thereby making mask main bodies. Thereafter, these mask main bodies were subjected to a nitriding treatment in an ammonia atmosphere at 580° C. for 30 minutes, manufacturing ten types of shadow masks. When the compositions of the surface layers to a depth of 20 μm from the surfaces of these shadow masks were analyzed by X-ray diffraction, each shadow mask was found to consist of $Fe_4N$ and $Fe_3NiN$.

COMPARATIVE EXAMPLE 1

The components of an Fe—Ni-based alloy having the composition given in Table 1 below were melted and cast to make a cast material with dimensions of 200 mm×800 mm×200 mm. A shadow mask was manufactured from this cast material following the same procedures as in Example 1 except that oxidation (blackening) was performed immediately after the press molding without performing any nitriding treatment.

COMPARATIVE EXAMPLE 2

The components of an Fe—Ni-based alloy having the composition given in Table 1 below were melted and cast to make a cast material with dimensions of 200 mm×800 mm×200 mm while nitrogen was introduced, so that a nitride was precipitated on the entire cast material. A shadow mask was manufactured from this cast material following the same procedures as in Example 1 except that no nitriding treatment was performed after the press molding. The shadow mask manufactured by this method could not be pressed into a desired shape due to its high interior and surface hardnesses.

Each of the shadow masks obtained in Examples 1 to 10 and Comparative Examples 1 and 2 was subjected to measurements of the hardness (the hardness of the surface layer) to a depth of 20 μm from the surface and the hardness (the hardness of the mask main body) at a depth of 0.1 mm from the surface. A color misregistration and howling of each shadow mask were also evaluated.

The color misregistration was evaluated from the degree of color misregistration caused by the thermal expansion of each shadow mask when the shadow mask was incorporated into the color-CRT mentioned earlier with reference to FIG. 1. The color misregistration was evaluated by four grades of 1; no color misregistration occurred, 2; a slight color misregistration occurred locally, 3; a medium color misregistration occurred locally, and 4; a color misregistration occurred on the whole. The howling was evaluated from the degree of color misregistration of each shadow mask when the shadow mask was incorporated into the color-CRT mentioned earlier with reference to FIG. 1 and subjected to an external vibration of 100 to 300 Hz. These results are summarized in Table 1 below.

TABLE 1

| | Alloy components (wt %) | | | | | Vickers Hardness | | | |
|---|---|---|---|---|---|---|---|---|---|
| | Ni | Mn | Si | Added element | Fe | Surface layer | Mask main body | *Color Misregistration | Howling |
| Example 1 | 35.8 | 0.32 | 0.030 | V: 0.28 | Balance | 288 | 138 | 1 | None |
| Example 2 | 35.6 | 0.28 | 0.026 | Cr: 0.41 | Balance | 275 | 130 | 1 | None |
| Example 3 | 35.6 | 0.27 | 0.033 | Nb: 0.25 | Balance | 272 | 134 | 1 | None |
| Example 4 | 35.7 | 0.30 | 0.030 | Ta: 0.30 | Balance | 270 | 135 | 1 | None |
| Example 5 | 35.5 | 0.31 | 0.028 | W: 0.22 | Balance | 271 | 136 | 1 | None |
| Example 6 | 35.9 | 0.26 | 0.030 | Mo: 0.34 | Balance | 275 | 135 | 1 | None |
| Example 7 | 36.1 | 0.28 | 0.029 | Ti: 0.25 | Balance | 293 | 132 | 1 | None |
| Example 8 | 35.6 | 0.29 | 0.033 | Al: 0.32 | Balance | 289 | 133 | 1 | None |
| Example 9 | 36.0 | 0.30 | 0.028 | V: 0.21<br>Nb: 0.25 | Balance | 302 | 135 | 1 | None |
| Example 10 | 35.8 | 0.28 | 0.030 | Ti: 0.18<br>Al: 0.24 | Balance | 305 | 138 | 1 | None |
| Comparative Example 1 | 36.2 | 0.30 | 0.025 | — | Balance | 142 | 140 | 1 | Found |
| Comparative Example 2 | 35.8 | 0.33 | 0.033 | Al: 0.45 | Balance | 175 | 172 | — | — |

*Evaluation of color misregistration
1; No color misregistration occurred.
2; A slight color misregistration occurred locally.
3; A medium color misregistration occurred locally.
4; A color misregistration occurred on the whole.

As can be seen from Table 1 above, any of the shadow masks obtained in Examples 1 to 10 caused neither color misregistration resulting from thermal expansion nor howling, indicating excellent characteristics.

Each of the surface layers of the shadow masks in Examples 1 to 10 consists of $Fe_4N$ and $Fe_3NiN$. A surface layer consisting of $Fe_4N$ and a surface layer consisting of $Fe_3NiN$ can be formed on the surface of each mask body by changing the composition of the Fe—Ni-based alloy as the material of the mask body and nitriding treatment conditions. Shadow masks having these surface layers have good characteristics, as in Examples 1 to 10, free from color misregistration and howling caused by thermal expansion.

EXAMPLES 11 & 12

The components of Fe—Ni-based alloys having the compositions shown in Table 2 below were melted and cast to make two types of cast materials with dimensions of 200 mm×800 mm×200 mm. Subsequently, these cast materials were hot-rolled in the same manner as in Example 1 and repeatedly subjected to cold rolling using cold rolls and annealing twice, thereby making 0.25 mm thick plate materials.

A large number of electron beam apertures were formed in a matrix manner in each plate material by photoetching, and the resultant plate material was annealed in a dry hydrogen atmosphere at 850° C. Subsequently, these plate materials were so press-molded as to have a predetermined mask shape, thereby making mask main bodies. Thereafter, ion implantation of boron was performed for these mask main bodies at an acceleration voltage of 1,000 keV and a dose of $10^{20}$ ions/cm$^2$. The resultant mask main bodies were then annealed in an argon gas atmosphere at 500° C. for 30 minutes to manufacture two types of shadow masks. When the components of the surface layers to a depth of 20 μm from the surfaces of these shadow masks were analyzed by X-ray diffraction, both the shadow masks were found to consist of $Fe_4B$ and $Fe_3NiB$.

EXAMPLES 13 & 14

The components of Fe—Ni-based alloys having the compositions shown in Table 2 below were melted and cast to make two types of cast materials with dimensions of 200 mm×800 mm×200 mm. Subsequently, these cast materials were hot-rolled in the same manner as in Example 1 and repeatedly subjected to cold rolling using cold rolls and annealing twice, thereby making 0.25 mm thick plate materials.

A large number of electron beam apertures were formed in a matrix manner in each plate material by photoetching, and the resultant plate material was annealed in a dry hydrogen atmosphere at 850° C. Subsequently, these plate materials were so press-molded as to have a predetermined mask shape, thereby making mask main bodies. Thereafter, ion implantation of silicon was performed for these mask main bodies at an acceleration voltage of 5,000 keV and a dose of $10^{21}$ ions/cm$^2$. The resultant mask main bodies were then annealed in an argon gas atmosphere at 500° C. for 30 minutes to manufacture two types of shadow masks. In the case where the components of the surface layers to a depth of 20 μm from the surfaces of these shadow masks were analyzed by X-ray diffraction, both the shadow masks were found to consist of $Fe_2Si$ and FeNiSi.

Each of the shadow masks obtained in Examples 11 to 14 was subjected to measurements of the hardness (the hardness of the surface layer) to a depth of 20 μm from the surface and the hardness (the hardness of the mask main body) at a depth of 0.1 mm from the surface. Following the same procedure as in Example 1, a color misregistration and howling of each shadow mask were also evaluated. These results are summarized in Table 2 below.

As can be seen from Table 2 above, any of the shadow masks obtained in Examples 11 to 14 caused neither color misregistration resulting from thermal expansion nor howling, indicating excellent characteristics.

Each of the surface layers of the shadow masks in Examples 11 and 12 consists of $Fe_4B$ and $Fe_3NiB$. However, a surface layer consisting of $Fe_4B$ and a surface layer consisting of $Fe_3NiB$ can be formed on the surface of each mask body by changing the compositions of the Fe—Ni-based alloys as the materials of the mask bodies, boron ion implantation conditions, and annealing conditions. Shadow masks having these surface layers have good characteristics, as in Examples 11 and 12, free from color misregistration and howling caused by thermal expansion.

Each of the surface layers of the shadow masks in Examples 13 and 14 consists of $Fe_2Si$ and FeNiSi. However, a surface layer consisting of $Fe_2Si$ and a surface layer consisting of FeNiSi can be formed on the surface of each mask body by changing the compositions of the Fe—Ni-based alloys as the materials of the mask bodies, silicon ion implantation conditions, and annealing conditions. Shadow masks having these surface layers have good characteristics, as in Examples 13 and 14, free from color misregistration and howling caused by thermal expansion.

EXAMPLES 15–25

The components of Fe—Ni-based alloys having the compositions given in Table 3 below were melted and cast to make eleven types of cast materials with dimensions of 200 mm×800 mm×200 mm. These cast materials were then hot-rolled between hot rolls at a temperature of 1,100° C. so as to have a plate thickness of 3 mm. Subsequently, each resultant hot-rolled material was repeatedly subjected to cold rolling using cold rolls and annealing twice, thereby making a 0.25 mm thick plate material.

A large number of electron beam apertures were formed in a matrix manner in each plate material by photoetching, and the resultant plate material was annealed in a dry hydrogen atmosphere at 900° C. for 20 minutes. Subsequently, these plate materials were so press-molded as to have a predetermined mask shape, thereby making mask main bodies. Thereafter, these mask main bodies were subjected to a nitriding treatment in an ammonia atmosphere at 550° C. for 10 minutes and then to oxidation in a carbon

TABLE 2

| | Alloy components (wt %) | | | | | Vickers Hardness | | | |
|---|---|---|---|---|---|---|---|---|---|
| | Ni | Mn | .Si | Added element | Fe | Surface layer | Mask main body | *Color Misregis-tration | Howling |
| Example 11 | 36.1 | 0.28 | 0.029 | Ti: 0.25 | Balance | 295 | 132 | 1 | None |
| Example 12 | 35.6 | 0.29 | 0.033 | Al: 0.32 | Balance | 290 | 133 | 1 | None |
| Example 13 | 36.0 | 0.30 | 0.028 | V: 0.21<br>Nb: 0.25 | Balance | 301 | 135 | 1 | None |
| Example 14 | 35.8 | 0.28 | 0.030 | Ti: 0.18<br>AL: 0.24 | Balance | 303 | 138 | 1 | None |

*Evaluation of color misregistration
1; No color misregistration occurred.
2; A slight color misregistration occurred locally.
3; A medium color misregistration occurred locally.
4; A color misregistration occurred on the whole.

dioxide gas atmosphere at 550° C. for 10 minutes, manufacturing eleven types of shadow masks. The surfaces of these shadow masks were found to be blackened. When the compositions of the surface layers to a depth of 20 fm from the surfaces of these shadow masks were analyzed by X-ray diffraction, each shadow mask was found to consist of $Fe_3O_4$, $Fe_4N$, and $Fe_3NiN$.

COMPARATIVE EXAMPLE 3

The components of an Fe—Ni-based alloy having the composition given in Table 3 below were melted and cast to make a cast material with dimensions of 200 mm×800 mm×200 mm. A shadow mask was manufactured from this cast material following the same procedures as in Example 15 except that oxidation was performed immediately after the press molding without performing any nitriding treatment.

COMPARATIVE EXAMPLE 4

The components of an Fe—Ni-based alloy having the composition given in Table 3 below were melted and cast to make a cast material with dimensions of 200 mm×800 mm×200 mm while nitrogen was introduced, so that a nitride was precipitated on the entire cast material. A shadow mask was manufactured from this cast material following the same procedures as in Example 15 except that oxidation was performed immediately after the press molding without performing any nitriding treatment. The shadow mask manufactured by this method could not be pressed into a desired shape due to its high interior and surface hardnesses.

Each of the shadow masks obtained in Examples 15 to 25 and Comparative Examples 3 and 4 was subjected to measurements of the hardness (the hardness of the surface layer) to a depth of 20 μm from the surface, the hardness (the hardness of the mask main body) at a depth of 0.1 mm from the surface, and the thermal reflectance of the surface. Following the same procedures as in Example 1, a color misregistration and howling of each shadow mask were also evaluated. These results are summarized in Table 3 below.

TABLE 3

| | Alloy components (wt %) | | | | | Vickers Hardness | | | | |
|---|---|---|---|---|---|---|---|---|---|---|
| | Ni | Mn | Si | Added element | Fe | Surface layer | Mask main body | Thermal reflect-ance | *Color Misregis-tration | Howling |
| Example 15 | 36.0 | 0.32 | 0.026 | — | Balance | 300 | 130 | 0.82 | 1 | None |
| Example 16 | 35.8 | 0.32 | 0.030 | V: 0.28 | Balance | 288 | 138 | 0.70 | 1 | None |
| Example 17 | 35.6 | 0.27 | 0.026 | Cr: 0.41 | Balance | 275 | 130 | 0.75 | 1 | None |
| Example 18 | 35.6 | 0.30 | 0.033 | Nb: 0.25 | Balance | 272 | 134 | 0.78 | 1 | None |
| Example 19 | 35.7 | 0.31 | 0.030 | Ta: 0.30 | Balance | 270 | 135 | 0.68 | 1 | None |
| Example 20 | 35.5 | 0.28 | 0.028 | W: 0.22 | Balance | 271 | 136 | 0.73 | 1 | None |
| Example 21 | 35.9 | 0.28 | 0.030 | Mo: 0.34 | Balance | 275 | 135 | 0.75 | 1 | None |
| Example 22 | 36.1 | 0.29 | 0.029 | Ti: 0.25 | Balance | 293 | 132 | 0.76 | 1 | None |
| Example 23 | 35.6 | 0.30 | 0.033 | Al: 0.32 | Balance | 289 | 133 | 0.72 | 1 | None |
| Example 24 | 36.0 | 0.28 | 0.028 | V: 0.21<br>Nb: 0.25 | Balance | 302 | 135 | 0.78 | 1 | None |
| Example 25 | 35.8 | 0.26 | 0.030 | Ti: 0.18<br>Al: 0.24 | Balance | 305 | 138 | 0.80 | 1 | None |
| Comparative Example 3 | 36.2 | 0.30 | 0.025 | — | Balance | 142 | 140 | 0.57 | 1 | Found |
| Comparative Example 4 | 35.8 | 0.33 | 0.033 | Al: 0.45 | Balance | 175 | 172 | — | — | — |

*Evaluation of color misregistration
1; No color misregistration occurred.
2; A slight color misregistration occurred locally.
3; A medium color misregistration occurred locally.
4; A color misregistration occurred on the whole.

As can be seen from Table 3 above, any of the shadow masks obtained in Examples 15 to 25 caused neither color misregistration resulting from thermal expansion nor howling, indicating excellent characteristics.

Each of the surface layers of the shadow masks in Examples 15 to 25 consists of $Fe_3O_4$, $Fe_4N$, and $Fe_3NiN$. However, a surface layer consisting of $Fe_3O_4$ and $Fe_4N$ and a surface layer consisting of $Fe_3O_4$ and $Fe_3NiN$ can be formed on the surface of each mask body by changing the compositions of the Fe—Ni-based alloys as the materials of the mask bodies, nitriding treatment conditions, and oxidation conditions. Shadow masks having these surface layers have high thermal reflectances and good characteristics, as in Examples 15 to 25, free from color misregistration and howling caused by thermal expansion.

EXAMPLES 26 & 27

The components of Fe—Ni-based alloys having the compositions shown in Table 4 below were melted and cast to make two types of cast materials with dimensions of 200 mm×800 mm×200 mm. Subsequently, these cast materials were hot-rolled in the same manner as in Example 15 and repeatedly subjected to cold rolling using cold rolls and annealing twice, thereby making 0.25 mm thick plate materials.

A large number of electron beam apertures were formed in a matrix manner in each plate material by photoetching, and the resultant plate material was annealed in a dry hydrogen atmosphere at 850° C. Subsequently, these plate materials were so press-molded as to have a predetermined mask shape, thereby making mask main bodies. Thereafter, ion implantation of boron was performed for these mask main bodies at an acceleration voltage of 1,000 keV and a dose of $10^{20}$ ions/cm$^2$. The resultant mask main bodies were then heat-treated in a carbon dioxide gas atmosphere at 500° C. for 30 minutes to manufacture two types of shadow masks. The surfaces of these shadow masks were found to be blackened. When the components of the surface layers to a depth of 20 fm from the surfaces of these shadow masks were analyzed by X-ray diffraction, both the shadow masks were found to consist of $Fe_3O_4$ and $Fe_4B$.

EXAMPLE 28

The components of an Fe—Ni-based alloy having the composition shown in Table 4 below were melted and cast to make a cast material with dimensions of 200 mm×800 mm×200 mm. Subsequently, the cast material was hot-rolled in the same manner as in Example 15 and repeatedly subjected to cold rolling using cold rolls and annealing twice, thereby making a 0.25 mm thick plate material.

A large number of electron beam apertures were formed in a matrix manner in the plate material by photoetching, and the resultant plate material was annealed in a dry hydrogen atmosphere at 850° C. Subsequently, the plate material was so press-molded as to have a predetermined mask shape, thereby making a mask main body. Thereafter, ion implantation of silicon was performed for the mask main body at an acceleration voltage of 5,000 kev and a dose of $10^{21}$ ions/cm$^2$. The resultant mask main body was then heat-treated in a carbon dioxide gas atmosphere at 500° C. for 30 minutes to manufacture a shadow mask. The surface of this shadow mask was found to be blackened. When the components of the surface layer to a depth of 20 μm from the surface of this shadow mask were analyzed by X-ray diffraction, the shadow mask was found to consist of $Fe_3O_4$ and $Fe_2Si$.

Each of the shadow masks obtained in Examples 26 to 28 was subjected to measurements of the hardness (the hardness of the surface layer) to a depth of 20 μm from the surface, the hardness (the hardness of the mask main body) at a depth of 0.1 mm from the surface, and the thermal reflectance of the surface. Following the same procedures as in Example 1, a color misregistration and howling of each shadow mask were also evaluated. These results are summarized in Table 4 below.

TABLE 4

| | Alloy components (wt %) | | | | | Vickers Hardness | | | | |
|---|---|---|---|---|---|---|---|---|---|---|
| | Ni | Mn | Si | Added element | Fe | Surface layer | Mask main body | Thermal reflect-ance | *Color Misregis-tration | Howling |
| Example 26 | 35.6 | 0.30 | 0.033 | Al: 0.32 | Balance | 286 | 133 | 0.72 | 1 | None |
| Example 27 | 36.0 | 0.28 | 0.028 | V: 0.21<br>Nb: 0.25 | Balance | 305 | 135 | 0.78 | 1 | None |
| Example 28 | 35.8 | 0.26 | 0.030 | Ti: 0.18<br>Al: 0.24 | Balance | 301 | 138 | 0.80 | 1 | None |

*Evaluation of color misregistration
1; No color misregistration occurred.
2; A slight color misregistration occurred locally.
3; A medium color misregistration occurred locally.
4; A color misregistration occurred on the whole.

As can be seen from Table 4 above, any of the shadow masks obtained in Examples 26 to 28 caused neither color misregistration resulting from thermal expansion nor howling, indicating excellent characteristics.

Each of the surface layers of the shadow masks in Examples 26 and 27 consists of $Fe_3O_4$ and $Fe_4B$. However, a surface layer consisting of $Fe_3O_4$ and $Fe_4NiB$ and a surface layer consisting of $Fe_3O_4$, $Fe_4B$, and $Fe_3NiB$ can be formed on the surface of each mask body by changing the compositions of the Fe—Ni-based alloys as the materials of the mask bodies, boron ion implantation conditions, and oxidation conditions. Shadow masks having these surface layers have high thermal reflectances and good characteristics, as in Examples 26 and 27, free from color misregistration and howling caused by thermal expansion.

The surface layer of the shadow mask in Example 28 consists of $Fe_3O_4$ and $Fe_2Si$. However, a surface layer consisting of $Fe_3O_4$ and FeNiSi and a surface layer consisting of $Fe_3O_4$, $Fe_2Si$, and FeNiSi can be formed on the surface of the mask body. Shadow masks having these surface layers have high thermal reflectances and good characteristics, as in Example 28, free from color misregistration and howling caused by thermal expansion.

As has been described above, the shadow mask according to the present invention has a low thermal expandability that the Fe—Ni-based alloy originally possesses and a high surface hardness. Since a color misregistration and howling are suppressed in a color-CRT incorporating this shadow mask, high-definition, high-quality images can be obtained by this color-CRT.

Another shadow mask according to the present invention has a low thermal expandability that the Fe—Ni-based alloy originally possesses, effectively reduces the temperature rise upon bombardment of electron beams, and has a high surface hardness. Therefore, images with extremely high definition and quality can be obtained by a color-CRT incorporating this shadow mask, since a color misregistration and howling are discouraged effectively in this color-CRT.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A shadow mask comprising:

a mask main body consisting of an Fe—Ni-based alloy containing iron and nickel as main constituents;

a large number of fine electron beam apertures formed in said mask main body; and a surface layer formed on the surface of said mask main body and containing at least one compound selected from the group consisting of iron nitride, iron nickel nitride, iron boride, iron nickel boride, iron silicide, and iron nickel silicide.

2. A shadow mask according to claim 1, wherein a nickel amount in said Fe—Ni-based alloy is 30 to 45 wt %.

3. A shadow mask according to claim 1, wherein said Fe—Ni-based alloy has a composition in which a portion of nickel is substituted with at least one metal selected from the group consisting of cobalt and chromium.

4. A shadow mask according to claim 3, wherein a substitution amount of said at least one metal selected from the group consisting of cobalt and chromium is 0.01 to 10 wt %.

5. A shadow mask according to claim 1, wherein said Fe—Ni-based alloy contains 0.01 to 0.5 wt % of at least one metal selected from the group consisting of vanadium, niobium, tantalum, tungsten, molybdenum, titanium, and aluminum.

6. A shadow mask according to claim 1, wherein said surface layer has a thickness of 0.1 to 20 μm.

7. A shadow mask according to claim 1, wherein said surface layer has a vickers hardness of not less than 170.

8. A shadow mask according to claim 1, wherein assuming that a hardness of said surface layer is $H_1$ and a hardness of said mask main body is $H_0$, a ratio ($H_1/H_0$) of the hardness of said surface layer to the hardness of said mask main body is not less than 1.05.

9. A shadow mask according to claim 1, wherein said at least one compound is $Fe_xN$, wherein $3.2 \leqq x \leqq 4.8$.

10. A shadow mask according to claim 1, wherein said at least one compound is $Fe_yNi_zN$, wherein $2.2 \leqq y \leqq 3.8$ and $0.2 \leqq z \leqq 1.8$.

11. A shadow mask according to claim 1, wherein said at least compound is $Fe_4B$.

12. A shadow mask according to claim 1, wherein said at least one compound is $Fe_3NiB$.

13. A shadow mask according to claim 1, wherein said at least one compound is $Fe_2Si$.

14. A shadow mask according to claim 1, wherein said at least one compound is FeNiSi.

15. A shadow mask comprising:

a mask main body consisting of an Fe—Ni-based alloy containing iron and nickel as main constituents;

a large number of fine electron beam apertures formed in said mask main body; and a surface layer formed on the surface of said mask main body and containing (a) $Fe_xO_4$, wherein $2.2 \leqq x \leqq 3.8$, and (b) at least one compound selected from the group consisting of iron nitride, iron nickel nitride, iron boride, iron nickel boride, iron silicide, and iron nickel silicide.

16. A shadow mask according to claim 15, wherein a nickel amount in said Fe—Ni-based alloy is 30 to 45 wt %.

17. A shadow mask according to claim 15, wherein said Fe—Ni-based alloy has a composition in which a portion of nickel is substituted with at least one metal selected from the group consisting of cobalt and chromium.

18. A shadow mask according to claim 17, wherein a substitution amount of said at least one metal selected from the group consisting of cobalt and chromium is 0.01 to 10 wt %.

19. A shadow mask according to claim 15, wherein said Fe—Ni-based alloy contains 0.01 to 0.5 wt % of at least one metal selected from the group consisting of vanadium, niobium, tantalum, tungsten, molybdenum, titanium, and aluminum.

20. A shadow mask according to claim 15, wherein said surface layer has a thickness of 0.1 to 20 μm.

21. A shadow mask according to claim 15, wherein said surface layer has a vickers hardness of not less than 170.

22. A shadow mask according to claim 15, wherein assuming that a hardness of said surface layer is $H_1$ and a hardness of said mask main body is $H_0$, a ratio ($H_1/H_0$) of the hardness of said surface layer to the hardness of said mask main body is not less than 1.05.

23. A cathode ray tube comprising:

an electron gun assembly for emitting electron beams;

a fluorescent screen for emitting light upon receipt of the electron beams; and a shadow mask provided between said electron gun assembly and said fluorescent screen, and comprising:

a mask main body consisting of an Fe—Ni-based alloy containing iron and nickel as main constituents;

a large number of fine electron beam apertures formed in said mask body; and a surface layer formed on the surface of said mask body and containing at least one compound selected from the group consisting of iron nitride, iron nickel nitride, iron boride, iron nickel boride, ion silicide, and iron nickel silicide.

24. A cathode ray tube comprising:

an electron gun assembly for emitting electron beams;

a fluorescent screen for emitting light upon receipt of the electron beams; and a shadow mask provided between said electron gun assembly and said fluorescent screen, and comprising:

a mask main body consisting of an Fe—Ni-based alloy containing iron and nickel as main constituents;

a large number of fine electron beam apertures formed in said mask body; and a surface layer formed on the surface of said mask body and containing (a) $Fe_xO_4$, wherein $2.2 \leqq x \leqq 3.8$, and (b) at least one compound selected from the group consisting of iron nitride, iron nickel nitride, iron boride, iron nickel boride, iron silicide, and iron nickel silicide.

* * * * *